US005396742A

United States Patent [19]

Romig et al.

[11] Patent Number: 5,396,742

[45] Date of Patent: Mar. 14, 1995

[54] JOINING AND ALIGNING SLEEVE FOR A HAZARDOUS MATERIAL CONTAINER STORAGE BUILDING AND RELATED METHOD

[75] Inventors: Frederick W. Romig, Wexford; Gary I. Murray, Pittsburgh, both of Pa.

[73] Assignee: CID Associates, Inc., Leechburg, Pa.

[21] Appl. No.: 125,074

[22] Filed: Sep. 21, 1993

Related U.S. Application Data

[60] Continuation-in-part of Ser. No. 997,050, Dec. 28, 1992, Pat. No. 5,285,617, which is a division of Ser. No. 678,830, Apr. 2, 1991, Pat. No. 5,191,742.

[51] Int. Cl.[6] ..... E04H 7/02

[52] U.S. Cl. ..... 52/79.9; 52/585.1; 52/745.01; 52/745.02; 403/14

[58] Field of Search ..... 52/585.1, 79.9, 745.01, 52/745.02; 403/13, 14; 446/120, 121, 122, 124, 119

[56] References Cited

U.S. PATENT DOCUMENTS

| | | | |
|---|---|---|---|
| 414,976 | 11/1889 | Harvey . | |
| 1,724,284 | 8/1929 | Imshenetsky et al. . | |
| 1,742,150 | 12/1929 | Rollins . | |
| 2,063,895 | 12/1936 | Mack | 446/120 |
| 2,861,388 | 11/1958 | Favaretto | 446/124 |
| 2,971,295 | 2/1961 | Reynolds . | |
| 3,073,476 | 1/1963 | Heacock . | |
| 3,089,716 | 5/1963 | Berkowitz | 403/13 |
| 3,173,226 | 3/1965 | Solnick . | |
| 3,480,174 | 11/1969 | Sherwood . | |
| 3,564,795 | 2/1971 | Henton . | |
| 3,566,554 | 3/1971 | Schaffer et al. . | |
| 3,691,708 | 9/1972 | Firnkas . | |
| 3,707,811 | 1/1973 | Hampson . | |
| 3,754,803 | 8/1973 | Undersood et al. . | |
| 3,818,655 | 6/1974 | Carter, Sr. . | |
| 3,823,972 | 7/1974 | Ramer . | |
| 3,871,146 | 3/1975 | Hamy . | |
| 3,965,627 | 6/1976 | Fencl . | |
| 4,083,154 | 4/1978 | Klink . | |
| 4,122,761 | 10/1978 | Westin et al. . | |
| 4,134,699 | 1/1979 | Schäfer et al. | 403/13 |
| 4,287,997 | 9/1981 | Rolfe et al. . | |
| 4,605,257 | 8/1986 | Lang et al. . | |
| 4,655,012 | 4/1987 | Downey et al. . | |
| 4,786,201 | 11/1988 | Huetter et al. . | |
| 4,819,820 | 4/1989 | Weiner . | |
| 4,848,617 | 7/1989 | Zygaj . | |
| 4,863,638 | 9/1989 | Harper, III . | |
| 4,875,595 | 10/1989 | Van Valkenburg . | |
| 4,932,178 | 6/1990 | Mozingo . | |
| 5,191,742 | 3/1993 | Romig et al. . | |

FOREIGN PATENT DOCUMENTS

| | | | |
|---|---|---|---|
| 271046 | 12/1987 | European Pat. Off. . | |
| 272529 | 12/1987 | European Pat. Off. . | |
| 640511 | 7/1950 | United Kingdom | 446/122 |

*Primary Examiner*—Carl D. Friedman
*Assistant Examiner*—Christopher Todd Kent
*Attorney, Agent, or Firm*—Arnold B. Silverman; David V. Radack

[57] ABSTRACT

An improved sleeve for facilitating joining and aligning two modules that form a single, unitary hazardous material container storage building. The sleeve has a central tube having an outer surface, an inner surface and a pair of ends and at least one guiding plate secured to the central tube. The guiding plate extends from each of the ends of the central tube for engaging into both the tubes of the first module and the second module. A hazardous material container storage building having the improved sleeve of the invention and a related method are also disclosed.

20 Claims, 9 Drawing Sheets

JOINING AND ALIGNING SLEEVE FOR A HAZARDOUS MATERIAL CONTAINER STORAGE BUILDING AND RELATED METHOD

CROSS-REFERENCE TO RELATED APPLICATIONS

This application is a continuation-in-part of U.S. patent application Ser. No. 07/997,050, filed Dec. 28, 1992, (now U.S. Pat. No. 5,285,617), which in turn was a divisional application of U.S. patent application Ser. No. 07/678,830, filed Apr. 2, 1991, (now U.S. Pat. No. 5,191,742, issued Mar. 9, 1993).

BACKGROUND OF THE INVENTION

1. Field Of The Invention

This invention relates to an improved joining and aligning sleeve for a hazardous material container storage building and a related method.

2. Background Discussion

Hazardous materials are frequently placed in fifty-five gallon cylindrical barrels typically measuring about twenty-two to twenty-three and one-half inches in diameter. The hazardous material can be stored in a liquid or solid form. These barrels must be kept in a building that has suitable safety features such as proper venting, fire and explosion protection and leakage protection.

A problem has arisen in providing storage for hazardous material containers. Buildings must be constructed to store the hazardous material containers. These buildings have to comply with safety standards mandated by Federal, state and local law in addition to meeting industry trade standards. However, these buildings need to be constructed quickly and with an eye towards future expansion of the floor space that is required to store hazardous material containers. In addition, available space for the containers must be used efficiently in order to minimize storage costs.

There remains a need for modular hazardous material container storage building and for an improved device for joining and aligning the modules to form a single, unitary hazardous material container storage building.

SUMMARY OF THE INVENTION

The improved joining and aligning sleeve for a hazardous material container storage building has met the above need. The improved joining and aligning sleeve comprises a central tube having an outer surface, an inner surface and a pair of ends and at least one guiding plate secured to the central tube. The guiding plate extends from each of the ends of the central tube for engaging into both the tubes of the first module and the second module which form the unitary, single hazardous material container storage building. The sleeve facilitates aligning and joining the first and second module to form the hazardous material container storage building.

A hazardous material container storage building is also disclosed. The hazardous material container storage building includes a plurality of modules each having a floor for supporting containers of hazardous material, a containment sump disposed underneath the floor for collecting leakage from the containers and tube means underlying the containment sump. The plurality of modules includes a first and second module each having tube means. Mechanical joining means extend at least partially through the tube means of the first module and the tube means of the second module. The mechanical joining means includes the improved sleeve of the invention comprising a central tube and a guiding plate secured to the central tube and extending from both ends of the central tube for engaging into the tube means of both of the first and second modules.

A method of joining a first module to a second module to form a single, unitary hazardous material container storage building is also disclosed.

It is an object of the invention to provide an improved device for facilitating joining and aligning two modules to form a single hazardous material container storage building.

It is a further object of the invention to reduce the time and effort needed to join two modules to form a single, unitary hazardous material storage container.

It is still another object of the invention to provide a strong, secure joining point for two modules.

It is yet another object of the invention to provide a joining and aligning sleeve that is inconspicuous once the two modules have been joined to form the hazardous material container storage building.

These and other objects of the invention will be fully understood from the following description of the invention with reference to the drawings appended to this application.

DESCRIPTION OF THE PREFERRED EMBODIMENTS

Figure 1:
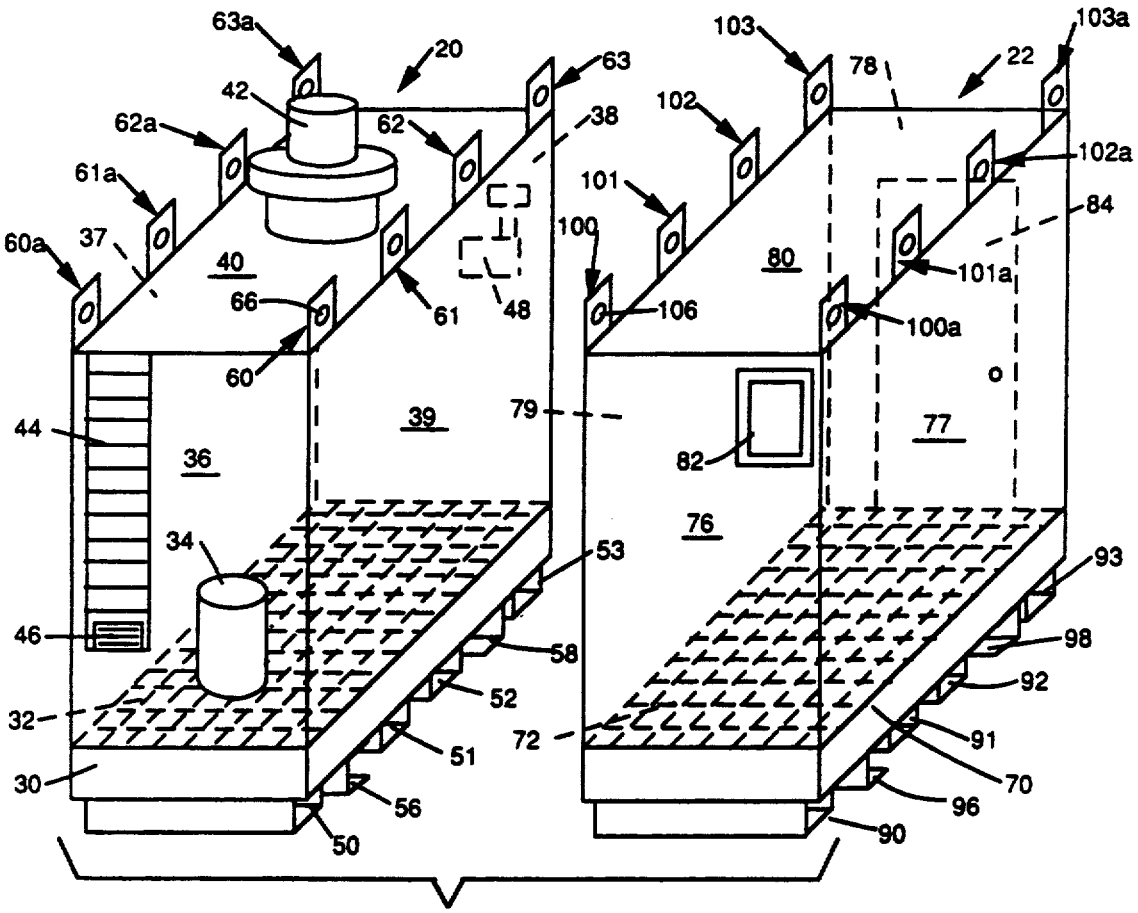
FIG. 1 is a perspective view of two spaced modules which together form a hazardous waste material container storage building.

Referring to FIG. 1 in greater detail, a first module 20 and a second module 22 which together form a single, unitary hazardous waste material container storage building are shown. Module 20 has a containment sump 30 which underlies an open grate flooring 32 made of steel or fiberglass. Flooring 32 supports a container 34 of hazardous waste material. Container 34 is typically in the form of a steel cylindrical barrel having a diameter of about twenty inches to twenty-three and one-half inches and a height of about two to four feet. Container 34 typically holds fifty-five gallons of hazardous waste material. Hazardous waste material can include solid and liquid hazardous waste.

The purpose of the containment sump 30 is to collect hazardous waste leakage that escapes from the container 34 and passes through the flooring 32. Containment sump 30 is self-contained in module 20 and is totally sealed from the ground upon which the module rests. The containment sump 30 also provides a visual indication of the leakage from the container 34.

Module 20 is further comprised of lateral walls 36, 37 and 38 extending generally vertically upwardly from flooring 32. One side of the module 20 has an open end 39. Disposed on top of the lateral walls 36, 37 and 38 is a roof 40. The walls 36, 37 and 38 and roof 40 can be ten gauge non-combustible steel construction. The building can be easily converted to a two-hour fire rated building by the addition of a layer of one and one-half inch insulation fiberglass batt sandwiched by two layers of one and one-half inch gypsum. The floor space in module 20 is approximately four hundred and eight square feet (thirty-four feet length by twelve feet in width) and the module 20 has an approximate height of six feet. As will be explained further hereinafter with respect to FIG. 13, the module 20 is designed on a twenty-four inch by twenty-four inch square grid system which will accommodate containers of hazardous waste, such as container 34.

First module 20 also may include a ventilator fan 42 mounted on the roof 40. The ventilator fan 42 can be mounted on the lateral walls 36–38 if desired. A ladder 44 is optionally provided on lateral wall 36 to provide access to the roof 40 of module 20. Disposed near the bottom of ladder 44 is a dampered vent 46 which allows escape of gaseous fumes from the inside of the building. Module 20 is also provided with a dry chemical fire suppression system 48.

Disposed beneath the containment sump 30 are four elongated tube means 50, 51, 52 and 53. The tube means 50, 51, 52 and 53 are hollow and in spaced parallel relationship to each other. The tube means 50–53 have a square configuration with dimensions of approximately four inches by four inches, the walls of the tubes 50–53 being about one-quarter of an inch thick. The containment sump 30, lateral walls 36, 37 and 38 and roof 40 are supported on and by the tubes 50, 51, 52 and 53. Also provided beneath the containment sump 30 are elongated supports 56 and 58 which are shown having a generally "C" shape. These supports 56 and 58 provide additional containment sump 30 support for the module 20 while also permitting visual access to the underside of the building.

Mounted to the roof 40 are securing means 60, 61, 62 and 63 and securing means 60*a*, 61*a*, 62*a* and 63*a*. Each securing means 60–63 and 60*a*–63*a* has a respective aperture, such as aperture 66 in securing means 60. All of the securing means are similarly designed and securing means 60 will be described in detail hereinafter with respect to FIG. 2. The securing means not only serve to join the modules to form a single, unitary hazardous waste material container storage building, but also serve as lifting lugs for moving and lifting module 20.

Module 22 is similar to module 20 and includes a containment sump 70 which underlies an open grate flooring 72. Flooring 72 is adapted to support hazardous waste material containers. As with containment sump 30, sump 70 collects hazardous waste leakage that escapes from containers of hazardous waste through flooring 72. Module 22 is further comprised of lateral walls 76, 77 and 78. One side 79 of module 22 is open. Disposed on top of lateral walls 76, 77 and 78 and secured thereon is a roof 80. The lateral walls 76, 77 and 78 and roof 80 are of the same construction and size as lateral walls 36, 37, 38 and roof 40, respectively. A vent 82 is provided in lateral wall 76 and a door 84 is provided in lateral wall 78. When modules 20 and 22 are joined together as will be explained hereinafter, a single, unitary hazardous waste material container storage building is formed.

Disposed beneath containment sump 70 are four elongated tube means 90, 91, 92 and 93. The tube means 90, 91, 92 and 93 are similar to tube means 50–53 and are in spaced parallel relationship to each other. The tube means 90–93 are hollow having a square configuration with dimensions of approximately four inches by four inches, the walls of the tubes 90–93 being about one-quarter of an inch thick. The containment sump 70, lateral walls 76, 77 and 78 and roof 80 are supported on and by the tube means 90, 91, 92 and 93. Also provided beneath the containment sump 70 are supports 96 and 98 which are shown having a generally "C" shape. These supports 96 and 98 provide additional containment sump support for the module 22 while also permitting visual access to the underside of the building.

Mounted to the roof 80 are securing means 100, 101, 102 and 103 and 100*a*, 101*a*, 102*a* and 103*a*. Each securing means 100–103 and 100*a*–103*a* has a respective aperture, such as aperture 106 in securing means 100. These securing means will also be discussed in detail hereinafter with respect to FIG. 2. The securing means not only serve to join the modules as one building, but also serve as lifting lugs for moving and lifting module 22.

Figure 2:
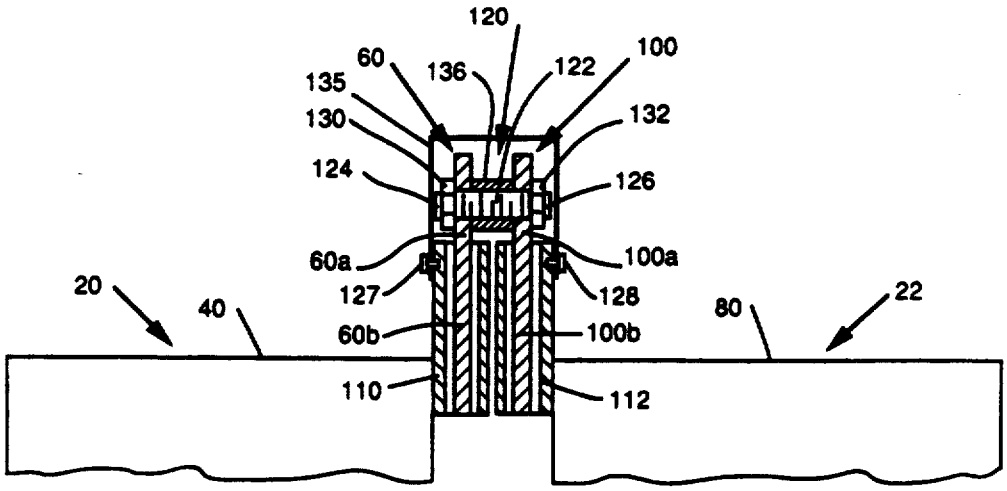
FIG. 2 is a partial side cross-sectional view of the modules joined together at the roof by the roof mechanical fastening means.

Referring now to FIG. 2, when it is desired to join module 20 to module 22, the modules 20 and 22 are moved so that the securing means 60, 61, 62 and 63 and securing means 100, 101, 102 and 103 have their respective apertures, such as 66 and 106, axially aligned. As can be seen in FIG. 2, securing means 60 is mounted in an elongated roof support tube 110 that forms part of the roof 40. A portion 60*a* of the securing means 60 extends above roof support tube 110 and a portion 60b is attached to the roof support tube 110 such as by welding. Securing means 100 is mounted in an elongated roof support tube 112 that is mounted to roof 80. A portion 100a of the securing means 100 extends above roof support tube 112 and a portion 100b is attached to the roof support tube 110 as by welding.

Once the securing means are axially aligned, a mechanical fastening means 120 is used to connect the securing means 60 and 100 and then join the two modules 20 and 22 to form a single, unitary hazardous waste material container storage building. The mechanical fastening means 120 includes a bolt 122 having a first threaded end portion 124 extending axially outwardly of portion 60a of securing means 60 and a second threaded end portion 126 extending axially outwardly of portion 100a of securing means 100. A first nut 130 is threaded onto the first threaded end portion 124 and is tightened down to be in intimate surface-to-surface securing contact with portion 60a. A second nut 132 is then threaded onto the second threaded end portion 126 and is tightened down to be in intimate surface-to-surface securing contact with portion 100a. It will be appreciated that a bolt having a threaded end and a fixed bolt head can also be used.

A cap 135 is provided to cover the securing means 60 and 100 and the fastening means 120. The cap 135 is preferably elongated and covers all securing means 60–63 and 100–103. The cap 135 is fastened to tubes 110 and 112 by fasteners, such as bolts 127 and 128 respectively. An annular hollow spacer 136 not only covers the fastening means 120 but also facilitates in aligning and positioning the modules 20 and 22.

It will be appreciated that a plurality of modules can be joined together as contemplated by the invention. A third module (not shown) could be attached to module 22 by utilizing securing means 100a–103a and four respective securing means on the third module.

Figure 3:
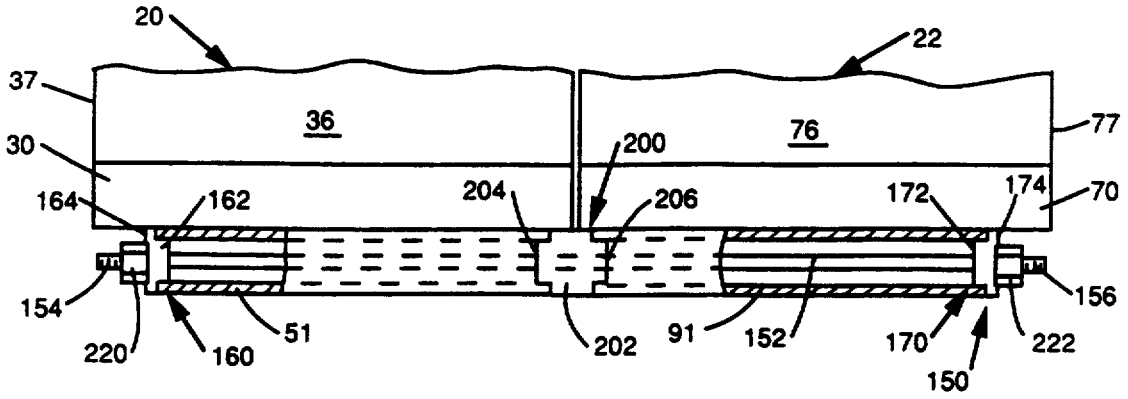
FIG. 3 is a partial detailed side elevational view, partially in section, of the modules joined together by the tube joining means.
Figure 4:
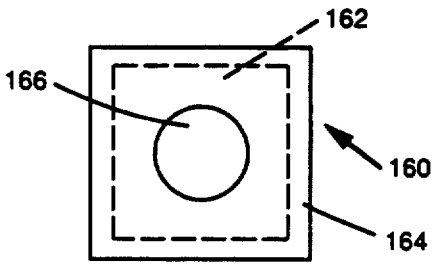
FIG. 4 is an elevational view of the end plate of the tube joining means.

Another method of joining modules 20 and 22 is shown in FIG. 3. In this embodiment, elongated parallel tube means 50–53 are axially aligned with tube means 90–93. An elongated mechanical joining means 150 is shown which includes an elongated rod 152 having a first threaded end portion 154 and a second threaded end portion 156. The first threaded end portion 154 extends axially outwardly of the tube means 51 and the second threaded end portion 156 extends axially outwardly of the tube means 91, but both threaded end portions 154 and 156 are recessed from the edge of lateral walls 37 and 77 respectively as is shown in FIG. 3. A first end plate 160 is provided on threaded end portion 154. The first end plate 160 has a base section 162 and an enlarged section 164. Base section 162 is dimensioned so as to fit inside tube 51, whereas enlarged section 164 is dimensioned so as to contact the outside edges of tube 51 as is shown in FIG. 3. Referring to FIG. 4, end plate 160 has an aperture 166. The elongated rod 152 passes through aperture 166.

A second end plate 170 is also provided on threaded end portion 156. The second end plate 170 has a base section 172 and an enlarged section 174. Base section 172 is dimensioned so as to fit inside tube 91 whereas enlarged section 174 is dimensioned so as to contact the outside edges of tube 91 as is shown in FIG. 3. Second end plate 170 has a similar aperture (not shown) as does first end plate 160, through which rod 152 passes.

Figure 5:
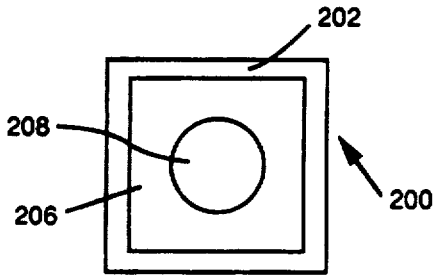
FIG. 5 is an elevational view of the divider plate of the tube joining means.

A divider plate 200 is disposed between tubes 51 and 91. The divider plate 200 helps to resist shifting of the building. The divider plate has an enlarged central section 202, a first end section 204 and a second end section 206. Enlarged central section 202 is dimensioned so as to contact the outside edges of both tubes 51 and 91 whereas sections 204 and 206 are dimensioned so as to fit inside tube 51 and tube 91 respectively. Referring to FIG. 5, the divider plate has an aperture 208 through which passes rod 152.

In the method of joining modules 20 and 22, divider plate 200 is positioned in the tubes 51 and 91 and rod 152 is passed through aperture 208 so that first threaded end portion 154 extends axially outwardly of tube 51 and second threaded end portion 156 extends axially outwardly of tube 91. It will be appreciated that divider plate 200 can also be first placed into either tube 51 or 91 and when module 20 or 22 is moved towards the other module, the free end of the divider plate 200 containing the protruding section can engage the inside of the tube means of the other module. Once the rod 152 is passed through the divider plate 200, the first end plate 160 and second end plate 170 are positioned as shown in FIG. 3. After this a first nut 220 is threaded onto first threaded end portion 154 and tightened down into intimate surface-to-surface contact with end plate 160. Finally, a second nut 222 is threaded onto second threaded end portion 156 and tightened down into intimate surface-to-surface contact with end plate 170. This will act to draw the modules 20 and 22 together to form a single, unitary hazardous waste material container storage building.

The tubes 50–53 and 90–93 provide an aesthetically pleasing appearance to the outside of the building. Tubes 50, 53, and 90, 93 located on the outside edges at the modules 20 and 22 prevent visual access to the underside of the building, thus making for a more streamlined appearance. If desired, the outside tubes 50, 53 and 90, 93 can be broken into sections so that one module has a discontinuous tube. This will facilitate access to the middle of a rod placed in the tube, but of course will affect the aesthetic appearance of the building.

The tubes also provide protection to the underside of the containment sumps 30 and 70 and generally provide structural support to the modules 20 and 22. The tube/-rod connection not only holds the modules 20 and 22 together, but also is used by the installers to pull the modules together once the lifting crane has the modules 20 and 22 within inches of each other. In addition, the tubes facilitate the feeding of rod 152 under the building during installation. Finally, the tubes protect the rod 152 from attack by corrosive ambient elements underneath the building and essentially act to "seal" the rod 152 from the elements.

It will be appreciated that the securing means of FIG. 2 can be used together with the joining means shown in FIGS. 3–5.

Figure 6:
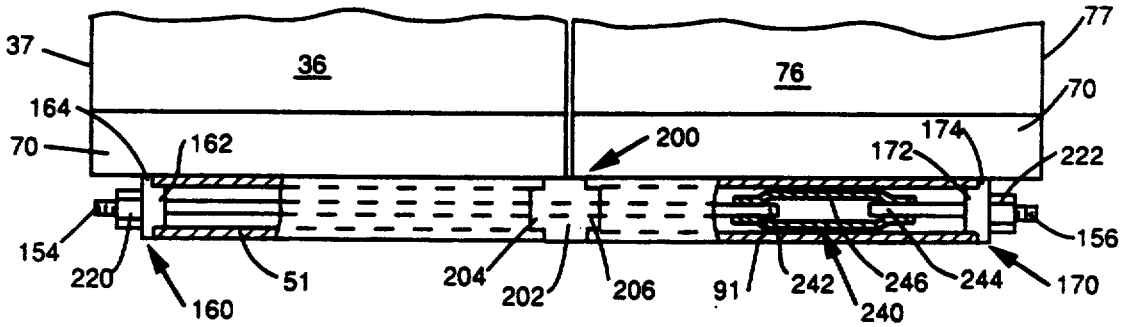
FIG. 6 is a view similar to FIG. 3 only showing another embodiment of the tube joining means.

Referring to FIG. 6, where like parts to those of FIG. 4 are identified by like reference numbers, an alternate embodiment of the rod means is shown. The rod means 240 in this embodiment consists of two separate rods 242 and 244 which are joined by a turnbuckle means 246. The rods used are typically in twenty foot sections, so when it is desired to lengthen the rod, two or more rods can be joined together using the turnbuckle 246.

Figure 7:
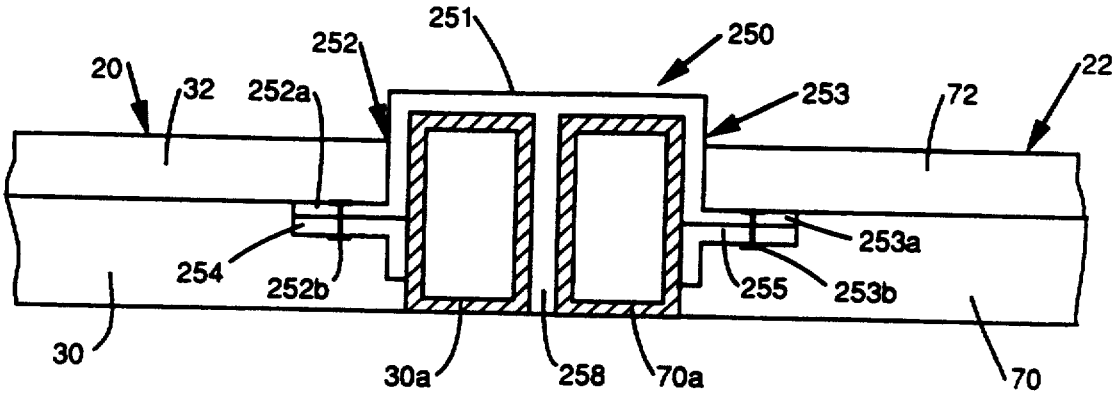
FIG. 7 is a partial side cross-sectional view of the modules joined together showing the containment sump cap.
Figure 7A:
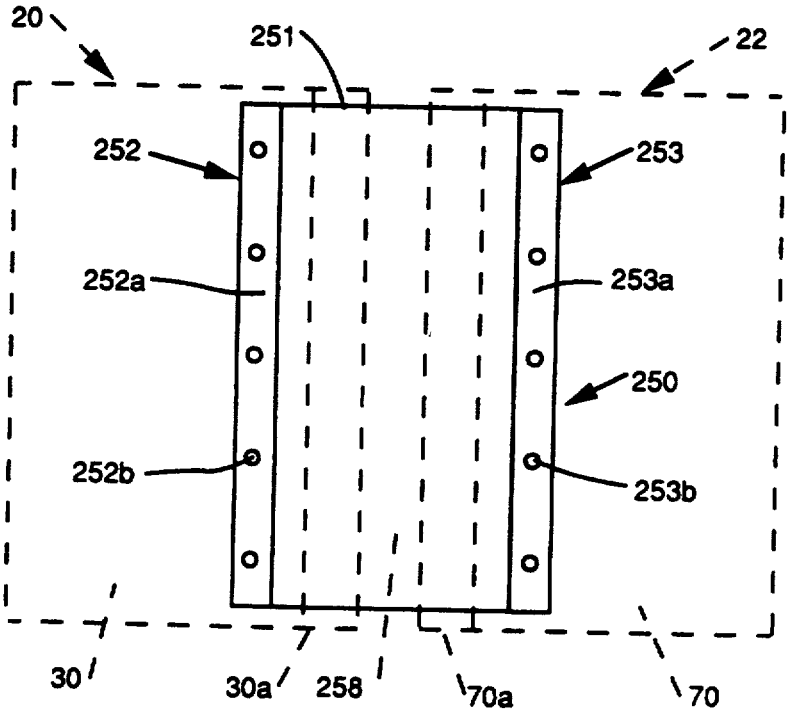
FIG. 7*a* is a top plan view of the modules joined together showing the containment sump cap.

Referring now to FIGS. 7 and 7a, the containment sump cap 250 of the invention will be explained. Once the modules 20 and 22 are joined together, it is desired to provide containment sump integrity. As was explained hereinbefore and was shown in FIG. 1, each module 20 and 22 has its own self-contained containment sump 30 and 70. This will promote containment sump integrity by providing a single containment sump for each module 20 and 22. Each containment sump 30 and 70 has an outer longitudinal hollow containment sump member 30*a* and 70*a*.

In order to further enhance containment sump integrity, a containment sump cap 250 is provided. The containment sump cap 250 has a top horizontal portion 251, a first side L-shaped flange 252 attached to the top portion 251 and a second side L-shaped flange 253 attached to the top portion 251. Portions 251, 252 and 253 can be integrally formed if desired. The horizontal sections 252*a* and 253*a* of the side flanges 252 and 253 are fastened by fasteners 252*b* and 253*b* to an elongated upside-down L-shaped members 254 and 255 connected to members 30*a* and 70*a*. Flooring 32 and 72 will rest on the horizontal sections 252*a* and 253*a* of flanges 252 and 253. The containment sump cap 250 will direct hazardous waste leakage into the containment sumps 30 and 70 and away from small opening 258 between modules 20 and 22, so as to resist hazardous waste leakage from reaching the ground upon which the module rest.

Figure 8:
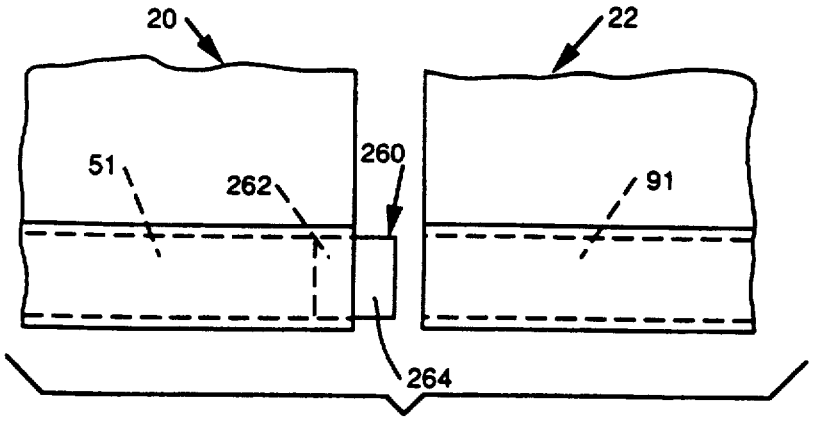
FIG. 8 is a detailed side elevational view showing the stabilizer plate as mounted in one tube and ready to be inserted into another tube.
Figure 9:
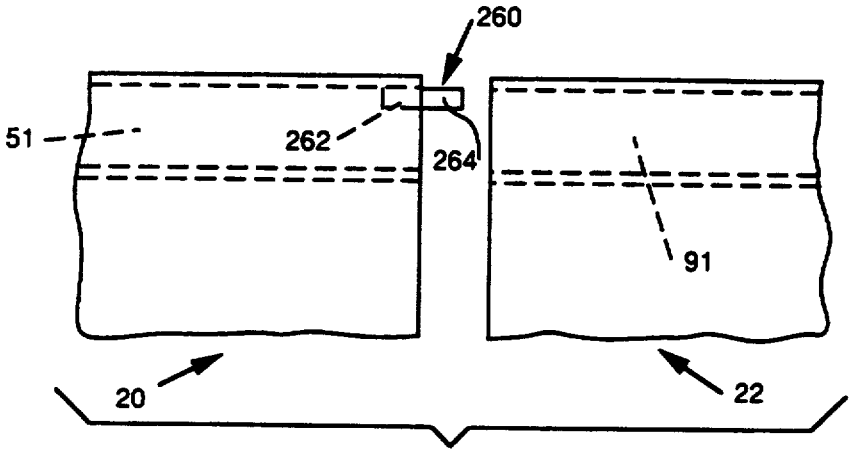
FIG. 9 is a top plan view of the stabilizer plate as mounted in one tube and ready to be inserted into another tube.

Referring now to FIGS. 8 and 9, a stabilizer plate 260 is shown which is mounted inside tube 51 and which is designed to fit into tube 91. The stabilizer plate 260 is used instead of the divider plate 200 shown in FIG. 3. The stabilizer plate 260 helps to align the tubes and properly join the two modules 20 and 22. Stabilizer plate 260 has a portion 262 secured to tube 51 as by welding and another free portion 264 which is designed to be disposed into tube 91 when the two modules 20 and 22 are joined to each other.

Figure 10:
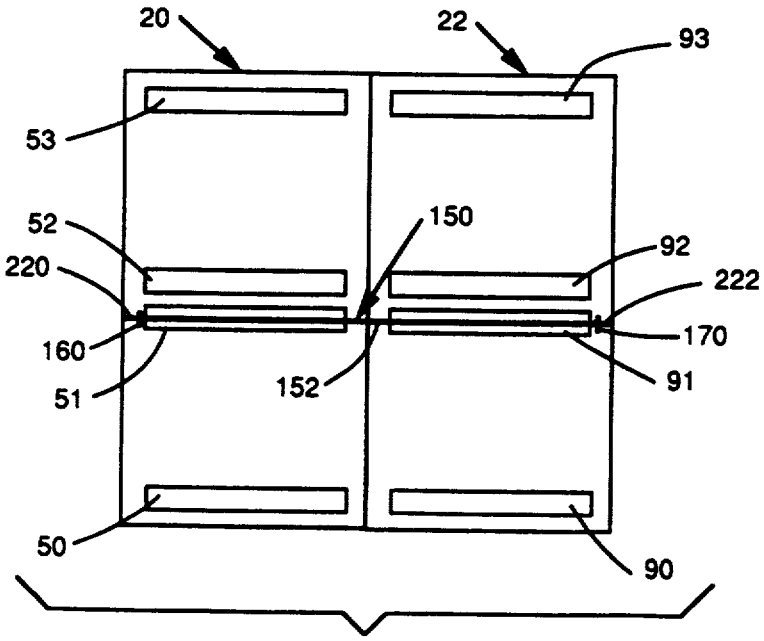
FIG. 10 is a schematic top plan view showing two modules joined together to form a unitary building.

Referring now to FIG. 10, a top plan schematic view of the two modules 20 and 22 as joined by the joining means 150 are shown. As described in connection with FIG. 1, module 20 has tubes 50, 51, 52 and 53 and module 22 has tubes 90, 91, 92 and 93. In order to join modules 20 and 22 to form a single, unitary hazardous waste container storage building, module 20 is placed approximately in its final position and the joining means 150 is placed through tube 51 so that about half of the rod 152 protrudes from the right side of tube 51. The end plate 160 is placed on the rod 152 and into position in the tube 51 as shown on FIG. 3. Nut 220 is then tightened down and welded into intimate surface-to-surface contact with end plate 160 so that end plate 160 is in securing contact with the left side of tube 51. Next, module 22, having tube 91, is moved into position so that the protruding portion of the rod 152 is inserted into tube 91. The tubes 90–93 are axially aligned with tubes 50–53. The end plate 170 is placed onto the rod 152 and nut 222 is tightened down and welded into intimate surface-to-surface contact with end plate 170 so that end plate 170 is in securing contact with the right side of tube 91. In this way, modules 20 and 22 will be joined as a single, unitary hazardous waste material storage containment building.

It will be appreciated that either the divider plate 200 or the stabilizer means 260 can be used to align and stabilize the buildings. For simplicity and clarity of illustration, neither of those mechanisms are shown on FIGS. 10–12.

Figure 11:
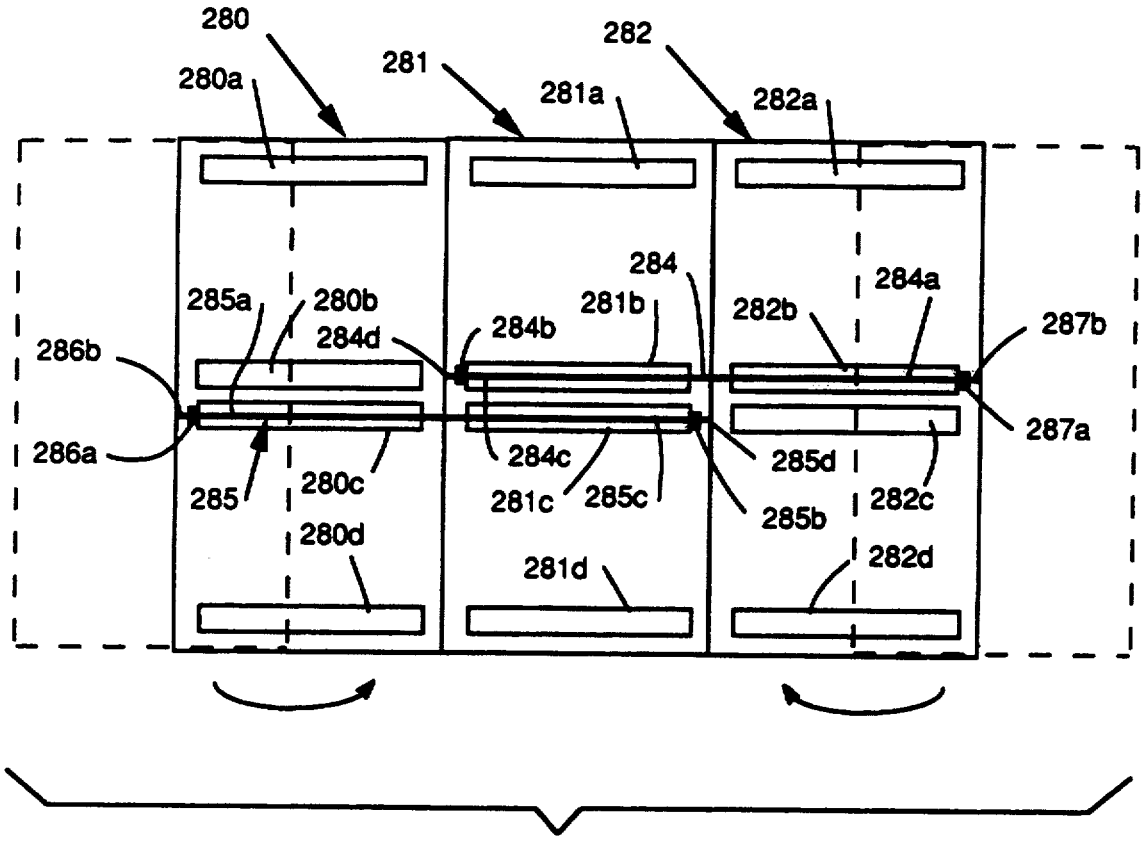
FIG. 11 is a schematic top plan view showing three modules joined together to form a unitary building.

FIG. 11 shows a top plan schematic view of joining three modules 280, 281 and 282 to form a single, unitary building. Module 280 includes tubes 280*a*, 280*b*, 280*c* and 280*d* and similarly, module 281 has tubes 281*a*, 281*b*, 281*c* and 281*d* and module 282 has tubes 282*a*, 282*b*, 282*c* and 282*d*. Module 280 and 282 are "end modules" having one closed lateral wall and one open later wall, whereas module 281 is a "middle module" which has two open lateral walls. It will be appreciated that when modules 280, 281 and 282 are joined together, the building has no interior partitions.

The method of joining modules 280, 281 and 282 is as follows: The middle module 281 is placed into its position first and a first rod means 284 is placed through tube 281*b* so that the right portion 284*a* of rod 284 protrudes from the right side of tube 281*b*. An end plate 284*b* is placed on the left portion 284*c* of the rod 284 and a nut 284*d* is tightened down and welded into intimate surface-to-surface contact with end plate 284*b* so that end plate 284*b* is in securing contact with tube 281*b* similar to end plate 160 on tube 51 as shown in FIG. 3. Next, a second rod means 285 is placed through tube 281*c* so that the left portion 285*a* of the rod 285 protrudes from the left side of tube 281*c*. An end plate 285*b* is placed on the right portion 285*c* of the rod 285 and a nut 285*d* is tightened down and welded into intimate surface-to-surface contact with end plate 285*b* so that end plate 285*b* is in securing contact with the right edge of tube 281*c*.

The next step is that either module 280 or 282 is moved into place. For example, module 280 is moved from the phantom position shown in FIG. 11 to its final position so that left portion 285*a* of rod 285 is inserted into tube 280*c*. An end plate 286*a* is placed on the left portion 285*a* of rod 285 and a nut 286*b* is tightened down and welded into intimate surface-to-surface contact with end plate 286*a* so that end plate 286*a* is in securing contact with the left edge of tube 280*c*. Finally, module 282 is moved from the phantom position shown in FIG. 11 to its final position so that right portion 284*a* of rod 284 is inserted into tube 282*b*. An end plate 287*a* is placed on the right portion 284*a* of rod 284 and a nut 287*b* is tightened down and welded into intimate surface-to-surface contact with end plate 287*a* so that end plate 287*a* is in securing contact with the right edge of tube 282*b*. In this way modules 280, 281 and 282 are joined to form a single, unitary hazardous waste material container storage building.

Figure 12:
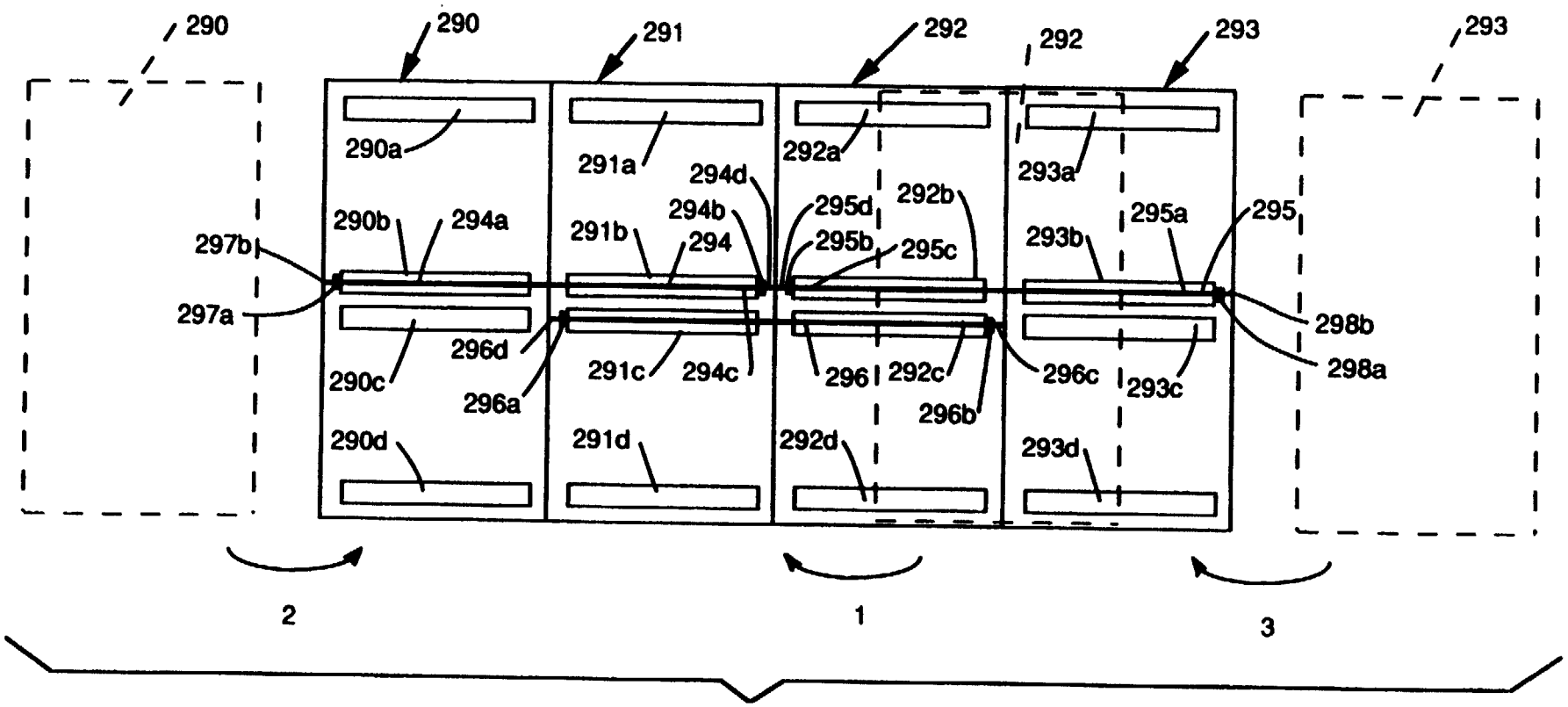
FIG. 12 is a schematic top plan view showing four modules joined together to form a unitary building.

FIG. 12 shows a top plan schematic view of four modules 290, 291, 292 and 293 that are joined together. These modules are joined to form a unitary building. Module 290 and 293 are "end modules" and modules 291 and 292 are "middle modules". Module 290 has tubes 290*a*, 290*b*, 290*c* and 290*d*. Module 291 has tubes 291*a*, 291*b*, 291*c* and 291*d*. Module 292 has tubes 292*a*, 292*b*, 292*c* and 292*d* and module 293 has tubes 293*a*, 293*b*, 293*c* and 293*d*.

The method of joining modules 290, 291, 292 and 293 is as follows. One of the middle modules 291 or 292, for example 291 is placed into position and a first rod means 294 is placed through tube 291*b* so that left portion 294*a* of rod 294 protrudes from the left side of tube 291*b*. An end plate 294*b* is placed on the right portion 294*c* of the rod 294 and a nut 294*d* is tightened down and welded into intimate surface-to-surface contact with end plate 294*b* so that end plate 294*b* is in securing contact with the right edge of tube 291*b*. Next, module 292 is placed near to module 291 but not in its final position and a second rod means 295 is placed through tube 292*b* so that right portion 295*a* of rod 295 protrudes from the right side tube 292*b*. An end plate 295*b* is placed on the left portion 295*c* of the rod 294 and a nut 295*d* is tightened down and welded into intimate surface-to-surface contact with end plate 295b so that end plate 295b is in securing contact with left edge of tube 292b. After this step, a third rod means 296 is inserted through tube 291c and tube 292c to join modules 291 and 292. Module 292 is moved towards module 291 and are brought together to form a single sub-unit by using an end plate 296a on the left side of tube 291c and an end plate 296b of the right side of tube 292c. A nut 296c is tightened down and welded into intimate surface-to-surface contact with end plate 296a so that end plate 296a is in securing contact with left edge of tube 291c. A nut 296d is tightened down and welded into intimate surface-to-surface contact with end plate 296b so that end plate 296b is in securing contact with right edge of tube 292c. At this point modules 291 and 292 form a single sub-unit.

Module 290 or module 293 can then be joined to the module 291 module 292 sub-unit. Module 290, for example, is moved from the phantom position shown in FIG. 11 to its final position so that left portion 294a of rod 294 is inserted into tube 290b. An end plate 297a is placed on the left portion 294a of rod 294 and a nut 297b is tightened down and welded into intimate surface-to-surface contact with end plate 297a so that end plate 297a is in securing contact with the left edge of tube 290b. This will form a sub-unit of module 290/module 291/module 292. Module 293 is the moved from the phantom position shown in FIG. 11 to its final position so that right portion 295a of rod 295 is inserted into tube 293b. An end plate 298a is placed on the right portion 295a of 295 and a nut 298b is tightened down and welded into intimate surface-to-surface contact with end plate 298a so that end plate 298a is in securing contact with the right edge of tube 293b. In this way, modules 290, 291, 292 and 293 are joined to form a single, unitary hazardous waste material container storage building.

It will be appreciated that five or more modules can be joined together by utilizing a similar procedure as was described above. For joining a fifth module to the four modules shown in FIG. 12, before the last step of joining module 293 to the module 2909/module 291/module 292 sub-unit, another rod would be placed in tube 293c to extend into the tube of a fifth module. That new rod would be welded to the left side of tube 293c and then module 293 would be joined to form a four module unit. Finally, the fifth module would be joined to the four module sub-unit. It will be appreciated that any number of modules can be utilized with this system. The concept is to start at the middle and add on to the sub-units that are formed until the desired size building is achieved. To add a new module to an existing building, a new middle module would be shipped to the customer, and the middle module placed in between an existing end module such as module 280 in FIG. 11 and an existing middle module such as 281 in FIG. 11. This would necessitate breaking the weld for the nuts that are threaded onto the rods.

Figure 13:
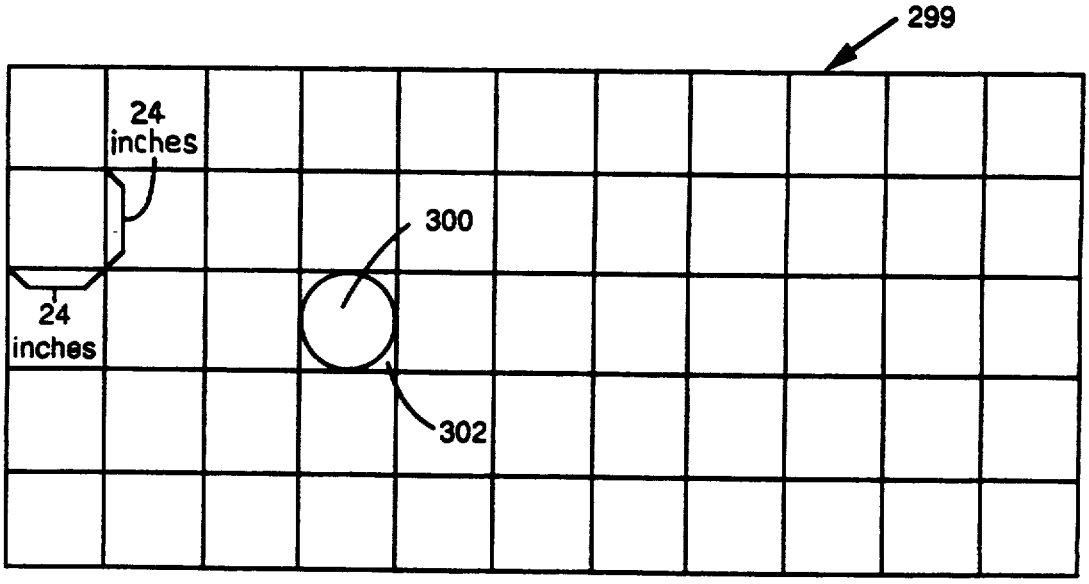
FIG. 13 is a schematic diagram of a floor used to support hazardous waste material containers which illustrates the grid design system of the invention.

Referring now to FIG. 13, the grid design system of the invention will be explained. Each module is designed to have an interior flooring grid system, with each grid being a square having sides of twenty-four inches. The grids can be marked on the floor if desired, but this is not necessary. As was explained hereinbefore, containers of hazardous waste are stored in cylindrical barrels having a diameter of about twenty to twenty-three and one-half inches and a height of about two to four feet. FIG. 12 shows the footprint of a barrel 300 in grid 302. The footprint is defined as the area of the floor underlying the barrel 30 when it rests on the floor. The barrel 300 is positioned in the grid so that there will be maneuvering room and spare space to allow a user's fingers to access the barrels. The grid design system keeps the building's total square footage to a minimum because the maximum amount of barrels is fit into the minimum amount of space. The grid design system also provides a method to allow aisles in the building by not placing barrels in certain grids. This allows "free and clear" access to the barrels in the building.

It will be appreciated that one method of the invention includes providing a first module having a floor for supporting containers of hazardous waste material and tube means underlying the floor and a second module having a floor for supporting containers of hazardous waste material and tube means underlying the floor. The method further comprises effecting relative closing displacement between the first and second modules and joining the first module to the second module by providing mechanical joining means extending at least partially through the first module tube means and the second module tube means.

An alternate method of the invention includes providing a first module having a floor for supporting containers of hazardous waste material, a plurality of sidewalls extending generally vertically from the floor, a roof disposed on the top of the sidewalls and securing means attached to the roof and extending generally vertically upwardly therefrom. The method further includes providing a second module having a floor for supporting containers of hazardous waste material, a plurality of sidewalls extending generally vertically from the floor, a roof disposed on top of the sidewalls and securing means attached to the roof and extending generally vertically upwardly therefrom. The method further includes effecting relative closing displacement between the first and second modules and joining the first module to the second module by providing fastening means passing through the first module securing means aperture and the second module securing means aperture.

Figure 14:
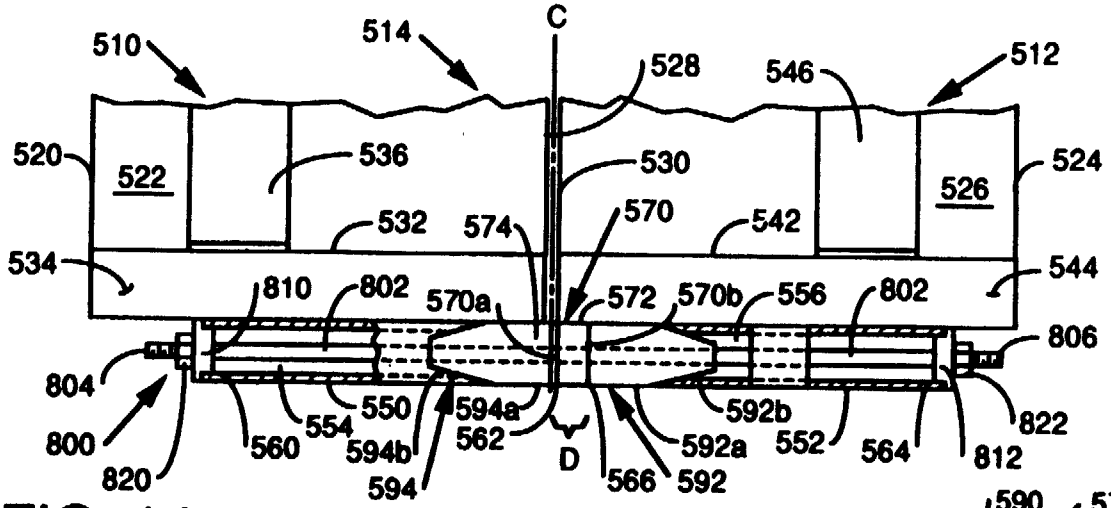
FIG. 14 is a partial detailed side elevational view, partially in section, of the modules joined together by mechanical joining means including the improved sleeve of the invention.
Figure 15:
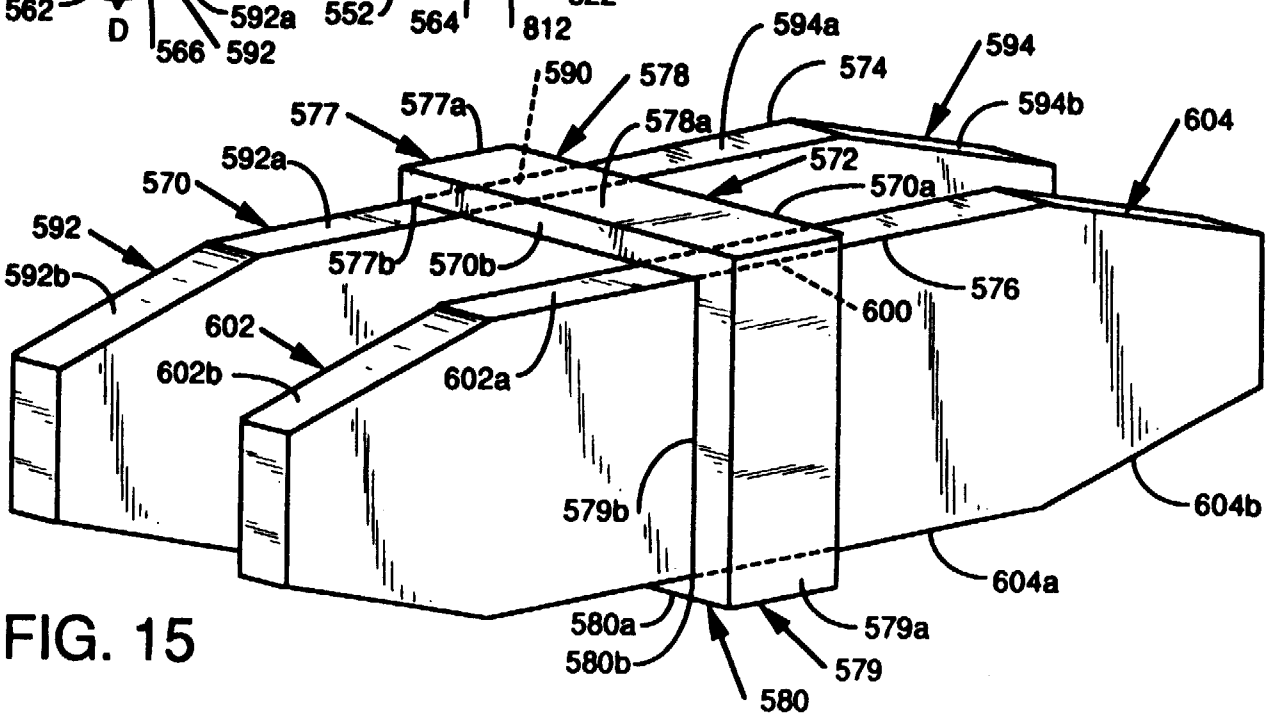
FIG. 15 is a perspective view of the sleeve of the invention.
Figure 16:
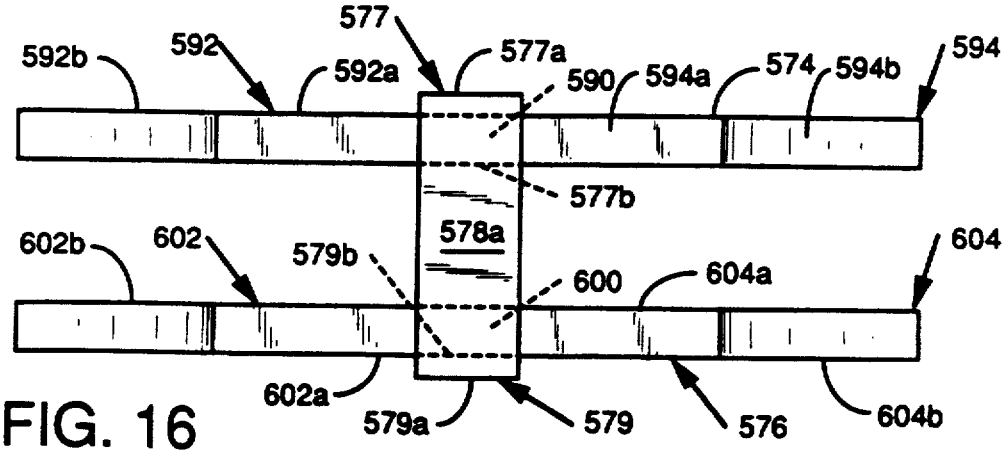
FIG. 16 is a top plan view of the sleeve of FIG. 15.

Referring now to FIG. 14, a partial detailed side elevational view of two modules 510 and 512 are shown as joined together to form a hazardous waste container storage building 514 made in accordance with the invention. The modules 510 and 512 are constructed similarly to modules 20 and 22 disclosed above. Each module includes three walls, only two of which, walls 520, 522 of module 510 and walls 524, 526 of module 512, are shown in FIG. 14. Each of the modules 510 and 512 have an open end 528 and 530 which are welded together at centerline C to form the hazardous waste storage container building 514.

Module 510 has a floor 532 and a containment sump 534 underlying the floor 532. The floor 532 supports a container of hazardous material, typically stored in a fifty-five gallon drum or barrel 536. Any leakage from the barrel 536 is collected in the containment sump 534 before it is leaked outside of the building 514. Module 512 also includes a floor 542 and a containment sump 544 underlying the floor 542. The floor 542 also supports a barrel 546 of hazardous material. Each modules 510 and 512 also includes a roof (not shown).

The modules 510 and 512 are joined to form building 514 by utilizing the tube means 550, 552 disposed underneath the containment sumps 534 and 544 of each respective module 510 and 512. The tube means 550 and 552 are similar in dimension and construction as the tube means disclosed above with reference to FIGS. 1 and 3. The tube means 550 and 552 are made of steel and have a cross-sectional shape in the form of a square. The tubes form passageways 554 and 556 respectively having a dimension of about four inches by four inches, with the walls of the tubes being about one-quarter of an inch thick. Each module 510 and 512 preferably contains at least two tube means, with one tube being disposed on each edge of the module. The tubes support the weight of the containment sumps, walls and roof of each respective module 510 and 512.

In the embodiment shown in FIG. 14, tube means 550 has an exposed end 560 and a joined end 562, with joined end 562 terminating at centerline C, whereas tube means 552 has an exposed end 564 and a joined end 566 having a termination point a recessed distance D from centerline C. It will be appreciated that the joined end 562 of tube 550 can be recessed from centerline C with joined end 566 of tube 552 having a termination point a recessed distance from centerline C. Finally, both joined ends 562, 566 can be recessed from centerline C.

The sleeve 570 of the invention is shown in position in FIG. 14 and separated from the hazardous material storage container building in FIGS. 15–19. The sleeve 570 defines a passageway 571 (see FIG. 19) formed by a central tube 572 and a pair of spaced apart guiding plates 574 and 576 (only guiding plate 574 is seen in FIG. 14). Central tube 572 has a cross-sectional shape and dimension generally the same as the cross-sectional shape of both tube 550 and tube 552. That is, central tube 572, as can best be seen in FIGS. 15–19, has a generally square cross-sectional shape. Central tube has two ends **570*a* and 570*b* and is formed by four walls 577, 578, 579 and 580. Each of the walls 577–580 has an outer surface 577*a*, 578*a*, 579*a*, 580*a* and an inner surface 577*b*, 578*b*, 579*b*, 580*b*. The walls 577–580 all have a thickness which is approximately equal to one-quarter of an inch, which is the same dimension as the wall thickness of tubes 550 and 552. The central tube 572** is preferably made of steel.

Guiding plate 574 is welded to inner surface **577*b* of wall 577. Guiding plate 574 consists of a central section 590 and two end sections 592 and 594 which extend from central section 590 and which also project outwardly from ends 570*b* and 570*a*, respectively. End section 592 consists of a straight portion 592*a* and a tapered portion 592*b* and end section 594 consists of straight portion 594*a* and a tapered portion 594*b*. As can be seen in FIG. 14, end section 592 engages into tube 552 with straight portion 592*a* being preferably frictionally engaged with the inner surface of tube 552 and end section 594 engages into tube 550 with straight portion 594*a* being preferably frictionally engaged with the inner surface of tube 550. In this way, a secure tight fit of the guiding plate 574 in tube 550 and tube 552** is obtained.

Figure 17:
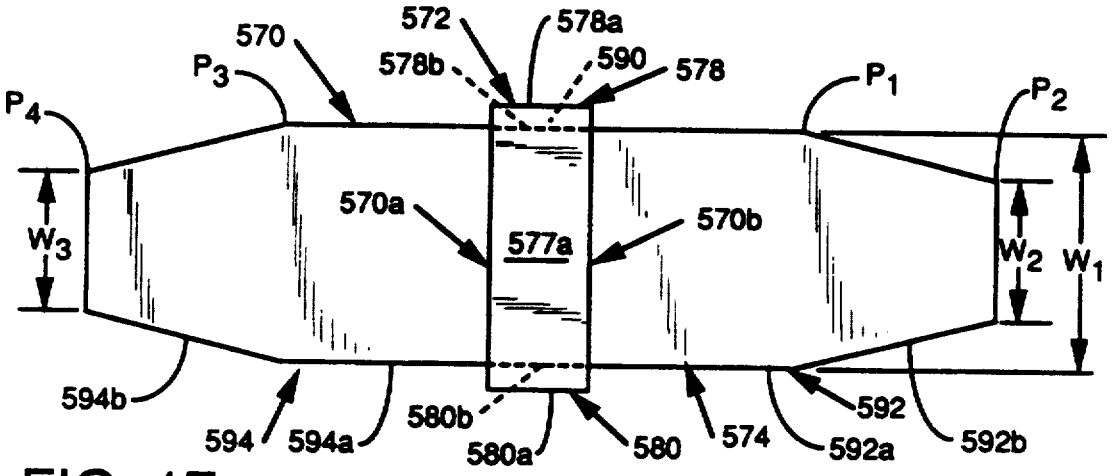
FIG. 17 is a front elevational view of the sleeve of FIG. 15.
Figure 18:
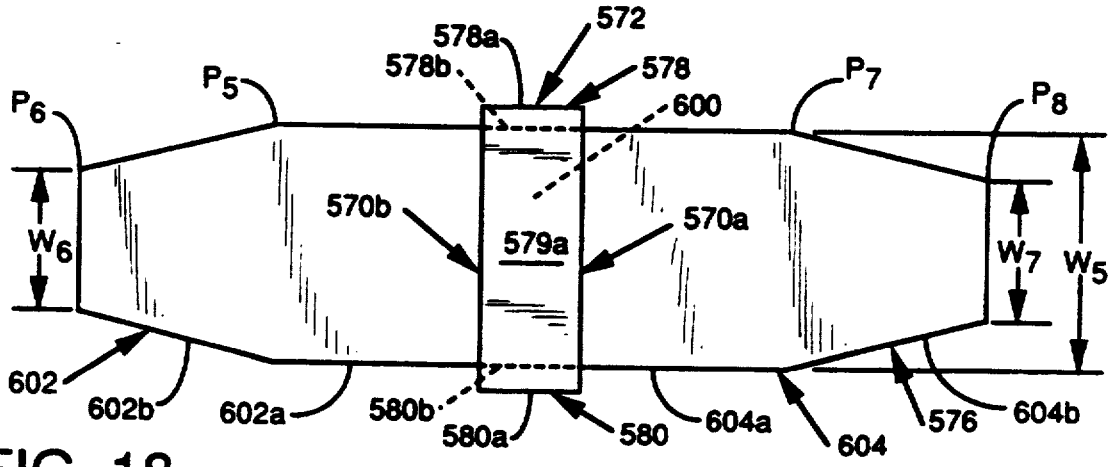
FIG. 18 is a back elevational view of the sleeve of FIG. 15.
Figure 19:
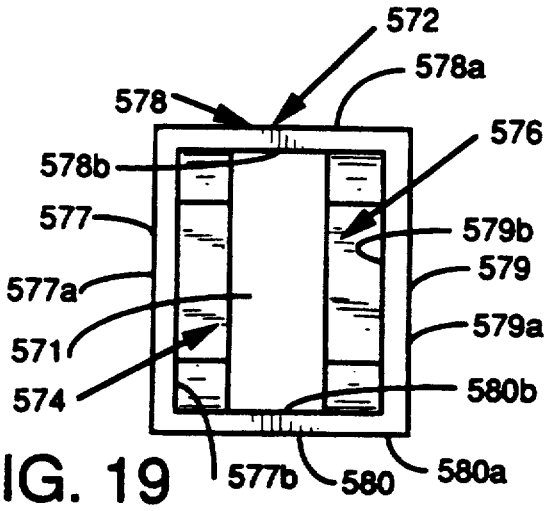
FIG. 19 is a left side elevational view of the sleeve of FIG. 15.

Referring to FIG. 17, the width $W_1$ of central section 590 and straight portions **592*a* and 594*a* are approximately equal to the distance between inner surfaces 578*b* and 580*b*. The width $W_2$ of the edge of tapered portion 592*b* of end section 592 and the width $W_3$ of tapered portion 592*b* of end section 592 are both less than width $W_1$ of central section 590. In addition, the width of the tapered portion 592*b* of end section 592 of guiding plate 574 tapers from width $W_1$ at point $P_1$ to width $W_2$ at point $P_2$ and similarly the width of the tapered portion 594*b* of end section 594 of guiding plate 574 tapers from width $W_1$ at point $P_3$ to width $W_3$ at point $P_4$. This will facilitate joining and aligning the tubes 550 and 552 of module 510 and 512** as will be explained below.

Guiding plate 576 is welded to inner surface **579*b* of wall 579. In this way, guiding plate 576 is in a spaced parallel relationship with guiding plate 574. Guiding plate 576 also consists of a central section 600 and two end sections 602 and 604 which extend from central section 600 and which also project outwardly from ends 570*b* and 570*a*, respectively. End section 602 consists of a straight portion 602*a* and a tapered portion 602*b* and end section 604 consists of a straight portion 604*a* and a tapered portion 604*b*. Similarly to end sections 592 and 594 (but not shown in FIG. 14), end section 602 engages into tube 552 with straight portion 602*a* being preferably frictionally engaged with the inner surface of tube 552 and end section 604 engages into tube 550 with straight portion 604*a* being preferably frictionally engaged with inner surface of tube 550**.

The width $W_5$ of central section 600 and straight portions **602*a* and 604*a* is approximately equal to the distance between inner surface 578*b* and 580*b*. The width $W_6$ of the edge of tapered portion 602*b* of end section 602 and the width $W_7$ of tapered portion 604*b* of end section 604 are both less than width $W_5$ of central section 600. It will be appreciated that width $W_1$ is equal to width $W_5$ and widths $W_2$ and $W_3$ are equal to widths $W_6$ and $W_7$, respectively. In addition, as with guiding plate 574, the width of tapered portion 602*b* of end section 602 of guiding plate 576 tapers from width $W_5$ at point $P_5$ to width $W_6$ and point $P_6$ and similarly the width of the tapered portion 604*b* of end section 604 of guiding plate 576 tapers from width $W_5$ and point $P_7$ to width $W_7$ at point $P_8$. This again will facilitate joining and aligning tubes 550 and 552 of modules 510 and 512** as will be explained below.

In the embodiment shown in FIGS. 15–19, widths W, and $W_5$ are approximately equal and widths $W_2$, $W_3$, $W_6$, $W_7$ are also approximately equal. End sections 592, 594, 602 and 604 extend approximately eight inches from respective ends **570*a* and 570*b* of central tube 572, with the straight portions 592*a*, 594*a*, 602*a* and 604*a* extending four inches from each end 570*a* and 570*b* respectively and tapered portions 592*b*, 594*b*, 602*b* and 604*b* extending four inches from the edges of straight portions 592*a*, 594*a*, 602*a* and 604*a* opposite each end 570*a* and 570*b* of central tube 572**.

It will be appreciated that the above dimensions and configurations of the sleeve 570 are provided as an example only. The sleeve 570 may have different dimensions and may include only one guiding plate secured to the central tube. Furthermore, the sleeve can include more than one guiding plate or one integral guiding plate that is secured to one or more of the inner walls of the central tube. A "half sleeve" is also contemplated wherein the guiding plate extends from only one end of the central tube. The half sleeve can be used on the non-joining end portions of tubes 550 and 552.

Referring back to FIG. 14, the sleeve 570 is used as follows. Sleeve 570 is first placed into tube 552 of module 512 (the tube which terminates a recessed distance D from centerline C) so that guiding plate 574 and 576 end sections 604 (not shown in FIG. 14) and 594 are projecting outwardly from module 512. After this, module 510 is joined to module 512 by guiding tube 550 into contact with end sections 594 and 604 of the sleeve 570. Because the end sections 594 and 604 project outwardly and because they are tapered in width, the tube 550 can be easily and precisely aligned to tube 552. When the modules 510 and 512 are joined to form the hazardous material container storage building 514 as is shown in FIG. 14, end 570*a* is in intimate surface-to-surface contact with exposed end 562 of tube means 550 and end 570*b* is in intimate surface-to-surface contact with exposed end 566 of tube means 552. This will create a smooth, uninterrupted joining area which is inconspicuous and aesthetically pleasing.

Figure 20:
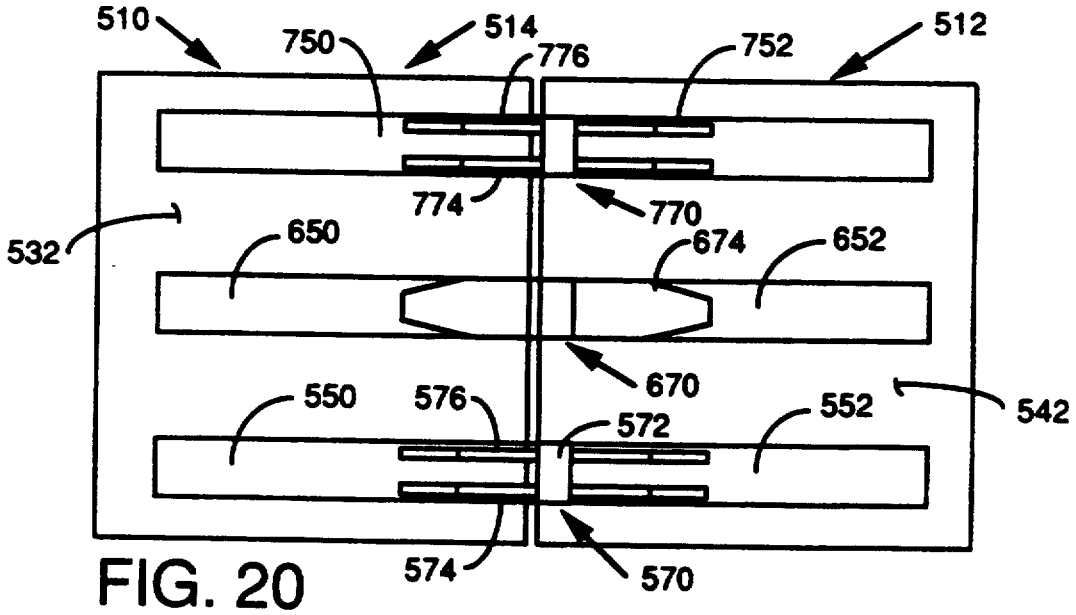
FIG. 20 is a bottom plan view showing three sets of tubes on the modules and the method that the sleeves of FIG. 15 can be used in association with the tubes to facilitate aligning and joining the modules.

Referring to FIG. 20, additional sleeves 670 and 770 are used similarly to align and join tubes 650, 652 and 750, 752 of the respective modules 510 and 512. It is preferred that sleeve 670 is rotated 90° relative to sleeve 570 so that its guiding plates (only one of which, guiding plate 674 is seen in FIG. 20) are parallel to the floors 532 and 542 of modules 510 and 512. Sleeve 770 is positioned similarly to sleeve 570 and is rotated 90° relative to sleeve 670 so that its guiding plates 774 and 776 are perpendicular to floors 532 and 542 of modules 510 and 512. It will be appreciated that this alternating sleeve position arrangement will impart greater strength in the joined building 514.

Once the tubes 550, 650, 750 of module 510 and tubes 552, 652, 752 of module 512 are aligned and positioned with respective sleeves 570, 670 and 770, the mechanical joining means shown in FIG. 14 can be connected. The mechanical joining means 800 is similar to mechanical joining means shown in FIG. 3 above except for the use of sleeve 570.

Referring back again to FIG. 14, rod 802 is passed through passageway 554 of tube 550, passageway 571 of sleeve 570 and passageway 556 of tube 552 so that threaded end portions 804 and 806 project from the exposed ends 560 and 564 of tubes 550 and 552. End plates 810 and 812 are then positioned as shown in FIG. 14 and first nut 820 is threaded onto threaded end portion 804 and tightened down into intimate surface-to-surface contact with end plate 810. Finally, a second nut 822 is threaded onto threaded end portion 806 and tightened down into intimate surface-to-surface contact with end plate 812. Similar mechanical joining means are used for tubes 650, 652 and 750, 752. This will act to draw the modules 510 and 512 together to form a single, unitary hazardous material container storage building.

Although the above disclosure has focused on joining two modules having tube means underlying a floor and a containment sump, it will be appreciated that the sleeve of the invention can be used to join and align modules having tube means disposed on the outside walls of the modules or vertical tube means, either disposed on the corners of the modules or on the walls of the modules, which join modules which are stacked one on top of the other.

It will be appreciated that the invention provides an improved sleeve for facilitating aligning and joining the tubes of a pair of modules that are joined to form a single, unitary hazardous material storage container building. The sleeve insures that the modules are aligned and secured properly in a simple and efficient manner.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A sleeve used to facilitate joining and aligning a first module having at least one tube means and a second module having at least one tube means to form a hazardous material container storage building, said sleeve comprising:

a central tube having an outer surface, an inner surface and a pair of open ends; and at least one guiding plate secured to said central tube, said guiding plate extending from each of said ends of said central tube for engaging into both said first and second module tube means, whereby said sleeve facilitates aligning and joining said first and second module to form said hazardous material container storage building.

2. The sleeve of claim 1, wherein said central tube has a cross-sectional shape and dimension;

said tube means of said first module has a cross-sectional shape and dimension;

said tube means of said second module has a cross-sectional shape and dimension; and said cross-sectional shape and dimension of said central tube, said tube means of said first module and said tube means of said second module are adapted to be generally the same.

3. The sleeve of claim 2, wherein said guiding plate is secured to said inner surface of said central tube.

4. The sleeve of claim 3, wherein said sleeve has a first guiding plate and a second guiding plate disposed in a spaced apart parallel relationship.

5. The sleeve of claim 4, wherein each of said first and second guiding plates has a central section and a pair of end sections, a portion of said central section being secured to said central tube;

said central section has a first width;

said end sections having a first portion adjacent to said central section and a second portion adjacent to said first portion; and said second portion having an average width less than said first portion.

6. The sleeve of claim 1, wherein said sleeve is made of steel.

7. The sleeve of claim 6, wherein said guiding plate is welded to said central tube.

8. A building for storing a plurality of hazardous material containers comprising:

a plurality of modules each having a floor for supporting containers of hazardous material, a containment sump disposed underneath said floor for collecting leakage from said containers, and tube means underlying said containment sump;

said plurality of modules including a first and second module, said first module having at least one tube means and said second module having at least one tube means;

mechanical joining and aligning means extending at least partially through a first tube means of said first module and a first tube means of said second module for securing said first module to said second module;

said mechanical joining and aligning means including at least one sleeve disposed between said first tube means of said first module and said first tube means of said second module, said sleeve comprising:

a central tube having an outer surface, an inner surface, a first end and a second end; and at least one guiding plate secured to said central tube, said guiding plate extending from said first end and said second end of said central tube for engaging into both said first tube means of said first module and said first tube means of said second module, whereby said sleeve facilitates aligning and joining said first module and said second module to form said hazardous material container storage building.

9. The building of claim 8, wherein said central tube has a cross-sectional shape and dimension;

said first tube means of said first module has a cross-sectional shape and dimension;

said first tube means of said second module has a cross-sectional shape and dimension; and said cross-sectional shape and dimension of said central tube, said first tube means of said first module and said first tube means of said second module are generally the same.

10. The building of claim 8, wherein said sleeve has a first guiding plate and a second guiding plate disposed in a spaced apart parallel relationship.

11. The building of claim 10, wherein said first module has a second tube means in spaced parallel relationship with said first tube means of said first module;

said second module has a second tube means in spaced parallel relationship with said first tube means of said second module;

a first sleeve disposed between said first tube means of said first module and said first tube means of said second module, said guiding plates of said first sleeve being disposed in a generally perpendicular relationship with said floor of said first module and said second module; and a second sleeve disposed between said second tube means of said first module and said second tube means of said second module, said guiding plates of said second sleeve being disposed in a generally parallel relationship with said floor of said first module and said second module.

12. The building of claim 11, wherein said first module has a third tube means in spaced parallel relationship with said first and second tube means of said first module;

said second module has a third tube means in spaced parallel relationship with said first and second tube means of said second module; and a third sleeve disposed between said third tube means of said first module and said third tube means of said second module, said guiding plates of said third sleeve being disposed in a generally perpendicular relationship with said floor of said first module and said second module.

13. The building of claim 8, wherein said first module is joined to said second module at a centerline;

said first tube means of said first module terminates a recessed distance from said centerline;

said first tube means of said second module terminates at said centerline; and said first end of said central tube is in intimate surface-to-surface contact with said first tube means of said first module and said second end of said central tube is in intimate surface-to-surface contact with said first tube means of said second module, whereby there is no exposed space between said first tube means of said first module and said first tube means of said second module.

14. The building of claim 8, wherein said first module is joined to said second module at a centerline;

said first tube means of said first module terminates at said centerline;

said first tube means of said second module terminates a recessed distance from said centerline; and said first end of said central tube is in intimate surface-to-surface contact with said first tube means of said first module and said second end of said central tube is in intimate surface-to-surface contact with said first tube means of said second module, whereby there is no exposed space between said first tube means of said first module and said first tube means of said second module.

15. The building of claim 8, wherein said first module is joined to said second module at a centerline;

said first tube means of said first module terminates a recessed distance from said centerline;

said first tube means at said second module terminates a recessed distance from said centerline;

said first end of said central tube is in intimate surface-to-surface contact with said first tube means of said first module and said second end of said central tube is in intimate surface-to-surface contact with said first tube means of said second module, whereby there is no exposed space between said first tube means of said first module and said first tube means of said second module.

16. A method of joining a first module to a second module to form a single, unitary hazardous material container storage building comprising:

providing a first module having at least one tube means;

providing a second module having at least one tube means;

placing into a first said tube means of said first module a first sleeve including (i) a central tube having an outer surface, an inner surface, and a pair of open ends and (ii) a guiding plate secured to said central tube, said guiding plate extending from each of said ends of said central tube so that a portion of said guiding plate is disposed in said first tube means of said first module and a portion extends from said first tube means of said first module;

effecting relative closing movement between said first and second modules such that a first said tube means of said second module engages into said portion of said guiding plate extending from said first tube means of said first module; and joining said first module to said second module by passing first mechanical joining means extending at least partially through said first tube means of said first module, said first sleeve and said first tube means of said second module and securing said mechanical joining means in position.

17. The method of claim 16, including before effecting relative closing movement between said first and second modules, providing said first module with a second tube means disposed in spaced parallel relationship with said first tube means of said first module;

providing said second module with a second tube means disposed in spaced parallel relationship with said first tube means of said second module; and placing into said second tube means of said first module a second sleeve including (i) a central tube having an outer surface, an inner surface and a pair of open ends; (ii) a guiding plate secured to said central tube, said guiding plate extending from each of said ends of said central tube so that a portion of said guiding plate is disposed in said second tube means of said first module and a portion extends from said second tube means of said first module.

18. The method of claim 17, including providing said first sleeve with a first guiding plate and a second guiding plate disposed in a spaced apart parallel relationship;

providing said second sleeve with a first guiding plate and a second guiding plate disposed in a spaced apart parallel relationship;

positioning said first sleeve in said first tube means of said first module so that said first and second guiding plates of said first sleeve are placed in a first position; and positioning said second sleeve in said second tube means of said first module so that said first and second guiding plates of said second sleeve are disposed in a plane generally perpendicular to the plane in which said first and second guiding plates of said first sleeve are disposed.

19. The method of claim 18, including providing said first module with a third tube means disposed in spaced parallel relationship with said first and second tube means of said first module;

providing said second module with a third tube means disposed in spaced parallel relationship with said first and second tube means of said second module; and placing into said third tube means of said first module a third sleeve including (i) a central tube having a outer surface, an inner surface and a pair of open ends; and (ii) a guiding place secured to said central tube, said guiding plate extending from each of said ends of said central tube so that a portion of said guiding plate is disposed in said third tube means of said first module and a portion extends from said third tube means of said first module.

20. The method of claim 19, including providing said third sleeve with a first guiding plate and a second guiding plate disposed in spaced apart parallel relationship; and positioning said third sleeve in said third tube means of said first module so that said first and second guiding plates of said third sleeve are disposed in a plane parallel to said plane in which said first and second guiding plates of said first sleeve are disposed.

* * * * *